US006657398B2

(12) United States Patent
Chang

(10) Patent No.: US 6,657,398 B2
(45) Date of Patent: Dec. 2, 2003

(54) DECORATIVE LIGHTS NETWORK

(76) Inventor: Chin Chen Chang, No. 9, Lane 305, Pei Ta Road, Hsin Chu (TW)

( * ) Notice: Subject to any disclaimer, the term of this patent is extended or adjusted under 35 U.S.C. 154(b) by 0 days.

(21) Appl. No.: 09/978,465

(22) Filed: Oct. 17, 2001

(65) Prior Publication Data

US 2003/0071580 A1 Apr. 17, 2003

(51) Int. Cl.[7] ..... H05B 37/00; F21S 13/14
(52) U.S. Cl. ..... 315/185 S; 362/252
(58) Field of Search ..... 315/185 S; 362/227, 362/249, 252, 397

(56) References Cited

U.S. PATENT DOCUMENTS 3,968,398 A * 7/1976 Lehmann et al. ..... 315/185 S
5,624,180 A * 4/1997 Lanning ..... 362/249
6,302,562 B1 * 10/2001 Wu ..... 362/252
6,309,087 B1 * 10/2001 Huang ..... 362/252

* cited by examiner

*Primary Examiner*—Don Wong
*Assistant Examiner*—Minh D A

(57) ABSTRACT

A decorative lighting network, which provides greater degree of illumination per foot or square foot of wire used to form the network. The lighting network is formed of a row of intertwined conductive insulated wire and a non-conductive wire, and at least one light string depending from the row of intermittent wire defining a plurality of diamond-shaped subnets with each subnet having a lamp at each node and at least one lamp intermediate the lamps at the nodes.

8 Claims, 10 Drawing Sheets

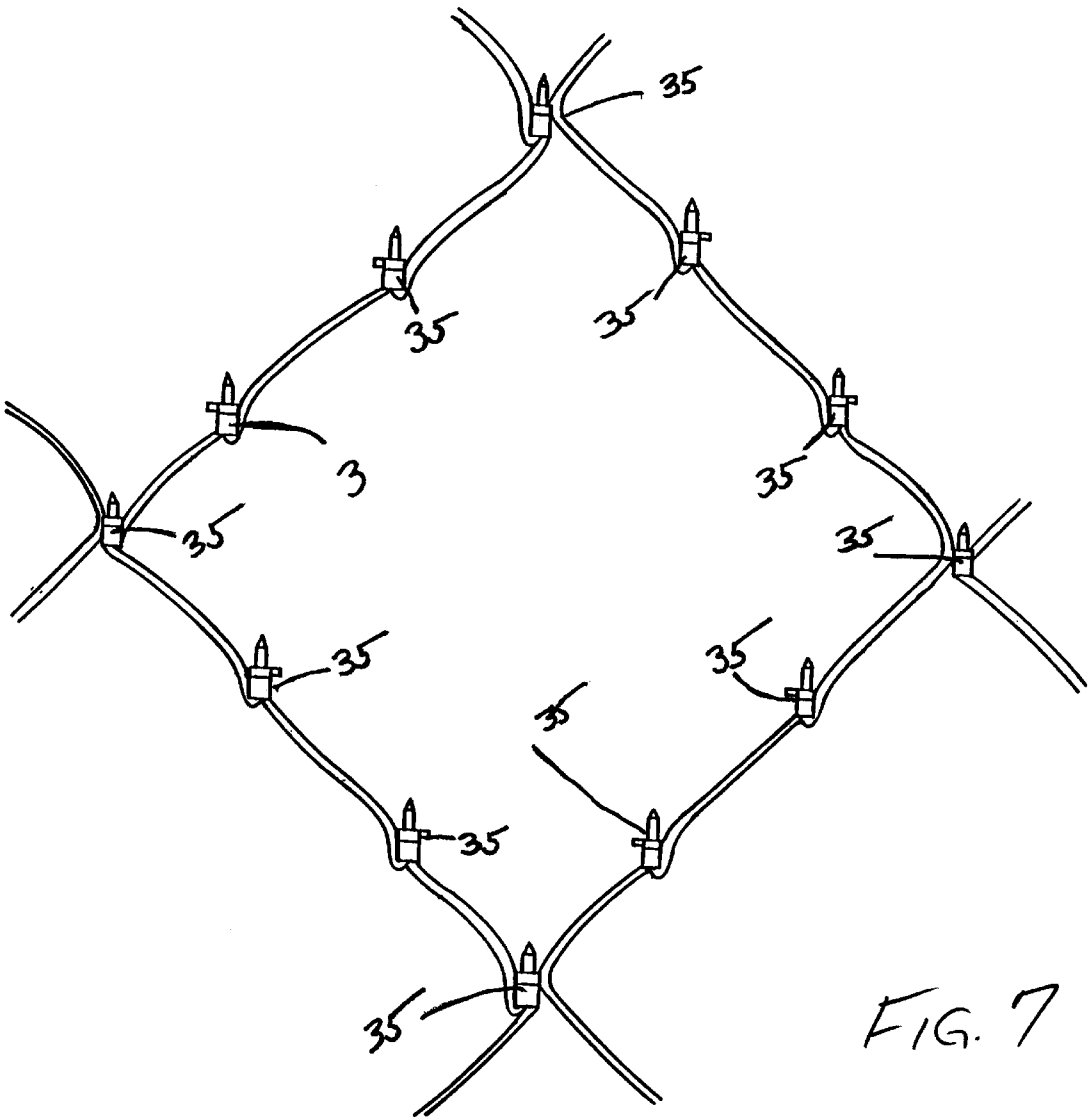
35
35
35

DECORATIVE LIGHTS NETWORK

FIELD OF THE INVENTION

The present invention relates generally to ornamental lights network used for decorative purpose and is particularly related to Christmas tree lights assembly made of a web or network structure comprising a plurality of electrically interconnected light elements. The net structure or lights assembly of the present invention is pre-fabricated and can be draped as a single net over a Christmas tree or building structures.

BACKGROUND OF THE INVENTION

A variety of Christmas lights network and decorative lighting assemblies are available for illuminating and decorating Christmas trees. Conventional illumination of a Christmas tree involves the use of a plurality of separate elongated, insulative, electrically conductive wire strings on which are mounted several lighting elements (lamps) which are spaced apart from each other. Each of these light elements comprises a female socket member which is adapted to receive a screw-in or bayonet-type lamp, strung in series or in parallel. The strings are attached at one or both ends to an electrical plug which provides the source of electricity. See U.S. Pat. No. 5,057,976 issued to Sheila DuMong on Oct. 15, 1991. As mentioned in said patent, however, the mounting of such plurality of separate strings of lights on a Christmas tree is both is burdensome and time-consuming task. In order to simplify decoration of a Christmas tree by illumination said patent provides a tree lighting assembly that incorporates a multiplicity of lamps in a net-like structure that can be readily mounted on a Christmas tree, and is easy to remove when not in use.

Other Christmas tree decorative illumination assemblies are described in the prior art patents disclosed in the DuMong patent. These are Crucefix U.S. Pat. No. 4,870,547 and Forrer U.S. Pat. No. 3,096,943. The DuMong patent also discloses two other patents, i.e., Ahoroni U.S. Pat. Nos. 4,720,773 and 4,736,282 which describe a mounting collar for use with conventional strings of Christmas lights.

In a more recent patent, i.e., U.S. Pat. No. 5,213,519 issued to David J. Dorfman on May 25, 1993, the patentee describes an electrical receptacle assembly which in one embodiment forms a flexible net. The receptacles receive light bulbs therein which, when illuminated, form a blanket of lights that can be draped over and around a Christmas tree. Other decorative light assemblies for Christmas trees are disclosed in U.S. Pat. Nos. 4,720,773; 5,338,585; and 5,424,925.

Decorative light assemblies have also been described in U.S. Pat. Nos. 5,645,342 and 5,984,491 issued Jul. 8, 1997 and Nov. 16, 1999, respectively, to Chin Chen Chang, the inventor named in this application. Basically the lighting networks described in these Chang patents as well as in most prior art patents comprise an array of subnets each comprising four lights which are connected to each other by electrical conductive wires. Thus, large quantities of wires will normally be needed to provide adequate illumination for a Christmas tree or other structure. The use of large quantity of wire for each network of lights increases the product cost hence forcing manufacturers to use less lights to become economically competitive. Thus, there is a dire need for light nets or lighting assemblies which utilize relatively less quantities of electrical wires, i.e., lower ratio of wire length to the number of light bulbs per network. One recent patent, i.e., U.S. Pat. No. 6,152,576 issued to Todd J. Mount on Nov. 28, 2000 discloses a method for providing a decorative array of spaced apart multiple light bulbs mounted on spaced apart rows of two intertwined insulated electrical wires connected to each light bulb. Even the lighting assembly described in this patent is limited to at most six light bulbs per subnet and does not sufficiently reduce the ratio of wire quantity to light bulbs to a favorable economic level.

Accordingly, it is an object of the present invention to provide an improved decorative lighting assembly.

It is another object of the present invention to provide decorative lighting assembly or network which utilizes minimal quantity of electrical wires per number of light bulbs while still providing adequate and sufficient lighting for the product.

It is also a further object of this invention to provide a decorative lighting assembly which permits the use of increased number of light bulbs per subnet of the network in order to provide more lighting with less quantity of wires.

The foregoing and other objects and features of the present invention will be more clearly comprehended from the ensuing detailed description and the accompanying drawings.

SUMMARY OF THE INVENTION

The present invention provide a decorative lighting network which is capable of providing greater degree of illumination (brightness) per foot or square foot of wire used to form the lighting network. Consequently less wire is needed to provide at lest the same degree of illumination as in the prior art lighting networks.

The lighting network described herein comprises a row of intertwined wires in the form of a rope, comprising an electrically conductive insulated wire and a non-conductive wire. One or more light strings, preferably a plurality of light strings depend from the row of intertwined wires and are formed in a pattern of repeating generally diamond shape subnets with each subnet having a lamp at each corner or node and at least one lamp therebetween attached to the wires, thus resulting in eight light lamps per subnet. Each of the electrically conductive wires is in electrical communication with a series of lamps and each of said non-conductive wires is disposed adjacent each lamp without establishing electrical contact therewith. A retaining means such as a clip or a ring is used to secure the wires alongside the lamps. More than one lamp may be used intermediate the nodes thus resulting in a total of eight or twelve lamps per subnet.

The lighting network may employ a single wire to form the subnets hence resulting in even less degree of wire consumption, and thus less cost per unit of wires used for a Christmas tree or other structure.

BRIEF DESCRIPTION OF THE DRAWINGS

In the drawings wherein like reference numerals are used to designate like parts.

FIG. 7 is a view similar to FIG. 6 but wherein each subnet of the network comprises twelve lamps, one at each node and two on each side;

DETAILED DESCRIPTION OF THE INVENTION

Figure 1:
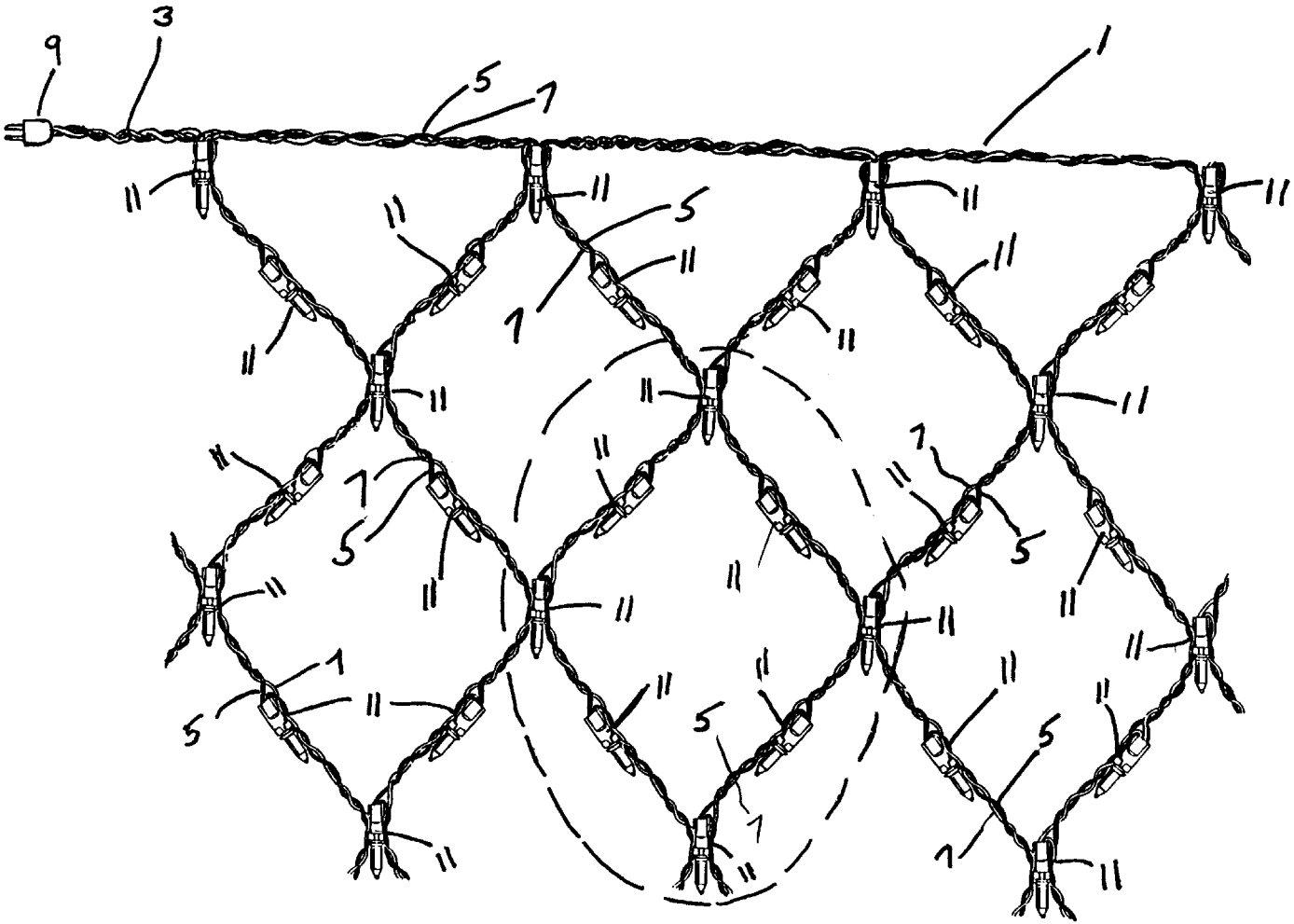
FIG. 1 is a front or plan view of a network (web) of lights arranged in accordance with one embodiment of the present invention wherein the network comprises an array of subnets each comprising eight light lamps.
Figure 2:
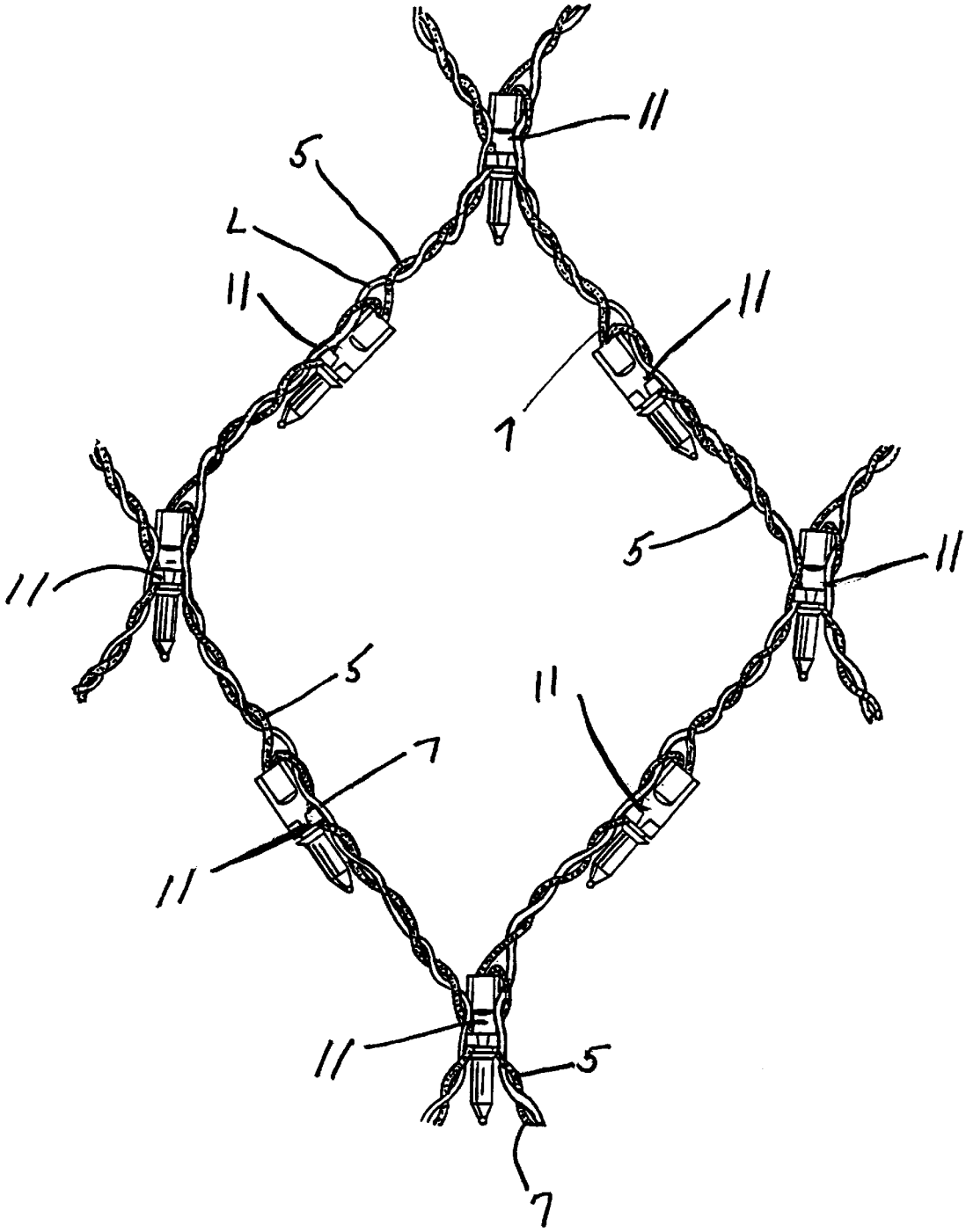
FIG. 2 is a front view of one subnet of the network shown in FIG. 1 within the oval broken lines.

Referring to FIGS. 1 and 2 a network 1 of electrical lights comprises a top row 3 of intertwined wires 5 and 7 in the form of a rope, and a plug 9 for connecting the wires to an electrical power source. One of the intertwined wires, i.e., the wire 5, is an electrically conductive insulated wire, whereas the other intertwined wire, i.e., wire 7, is a non-conductive wire. The intertwined wires 5 and 7 branch down as strings from the top row 3 to form an array of generally diamond-shaped subnets wherein each subnet comprises a lamp 11 at each corner or node and also located on each side, with the electrically conductive wires 5 are connected to each of the lamps. The other intertwined wire 7 bypasses each of the lamps 11 without establishing electrical contact with the lamps but serving in establishing the network 1.

Figure 4:
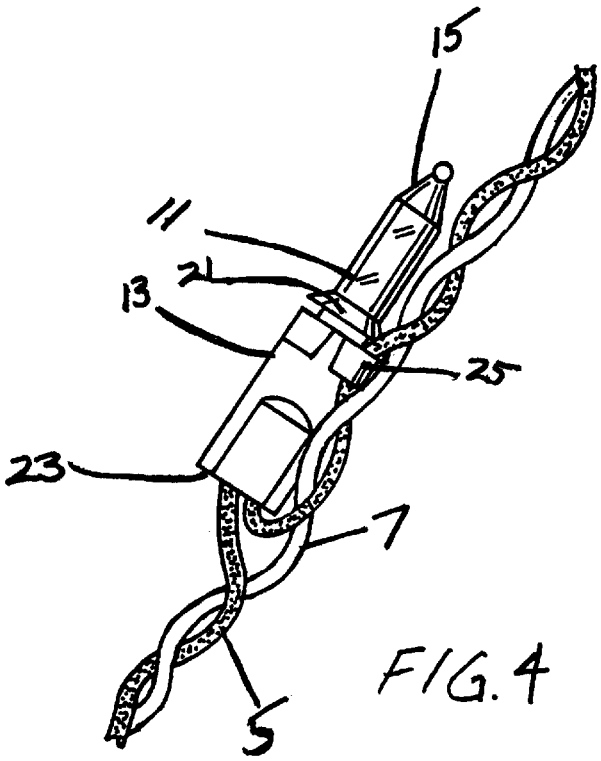
FIG. 4 is an enlarged perspective view of each lamp located on the side of the subnet shown within a dotted circle.
Figure 3:
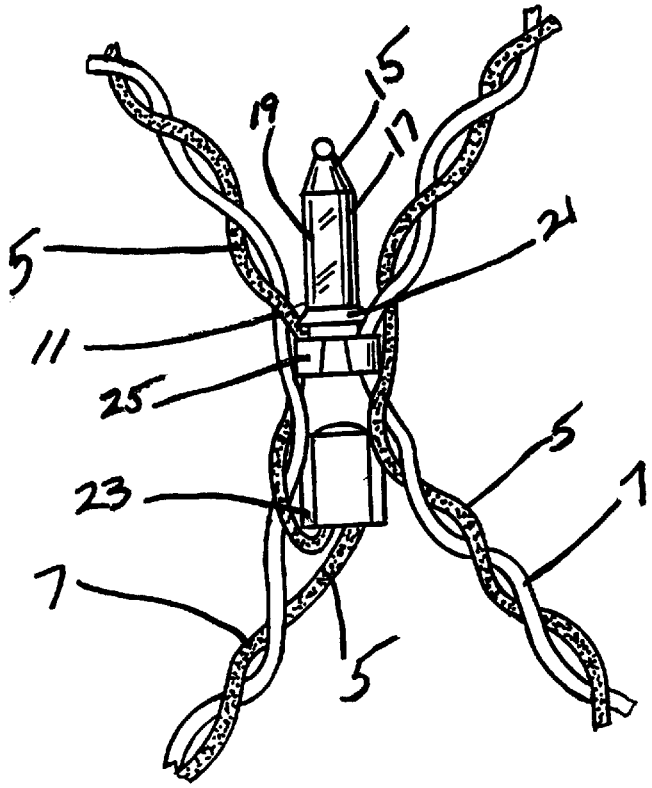
FIG. 3 is an enlarged perspective view of each lamp at the nodes or corners of each subnet shown in FIG. 2.
Figure 5:
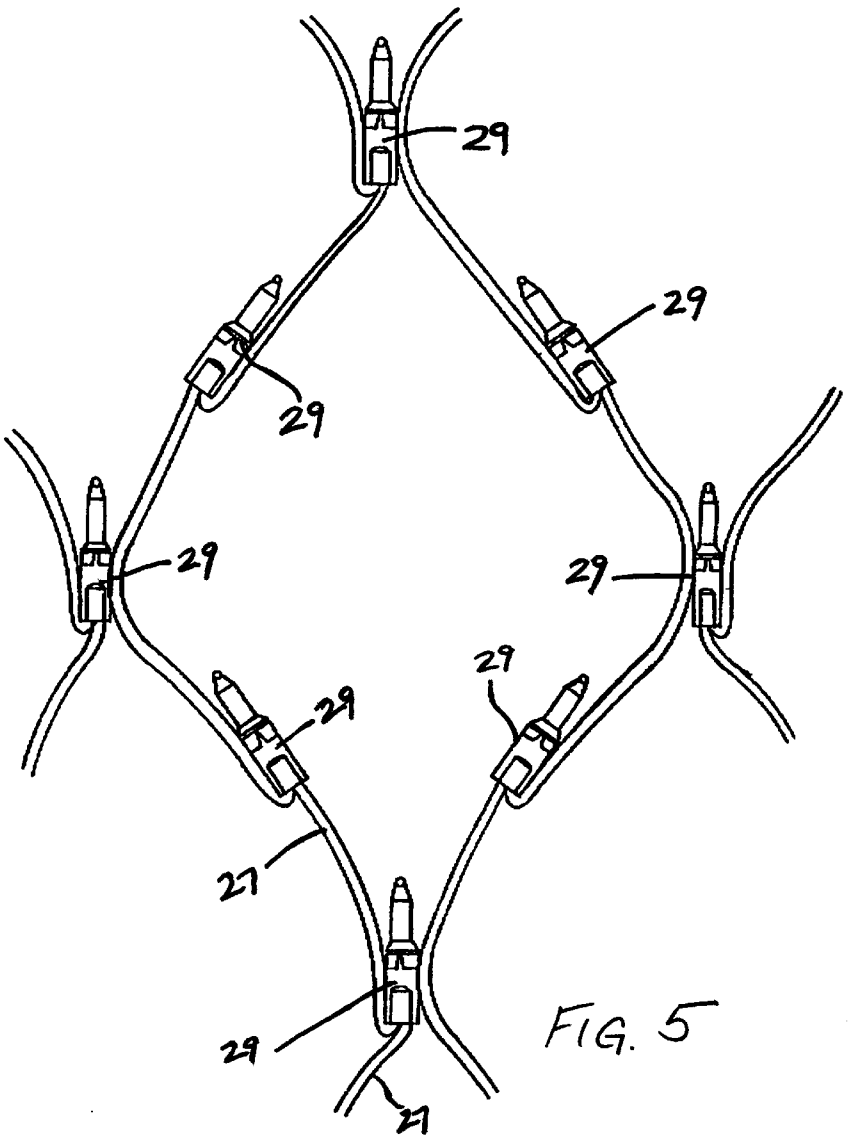
FIG. 5 is a front view of lights similar to FIG. 1 but showing a network comprising arrays of twelve lamps in each subnet.

FIGS. 3 and 4 illustrate each individual lamp 11 located at the nodes and sides, respectively, of each subnet of the network. Except for their locations and positions, the lamps 11 are identical in structure. Each lamp 11 comprises a cylindrical body 13, a bulb 15 having electrical filaments 17,19 and a bulb base 21 which fits into the socket 23. The conductive wire 5 enters each lamp and after making electrical contact with the filaments 17,19 exits from the lamp and enters the next lamp 11 in the series of lamps, and continues this pattern until all lamps are electrically energized. The non-conductive wire 7, however, bypasses each lamp and is retained against the outside of each lamp by a retaining ring or clip 25 and continues this pattern throughout the network. Thus, as it can be seen from FIGS. 1–4, the intertwined wires 5,7 form a pattern of lights in the form of a net or web with only the wire 5 establishing electrical contact and, together with the wire 7 defining a network lights which can be used to drape over a Christmas tree, a wall or other structure.

Figure 6:
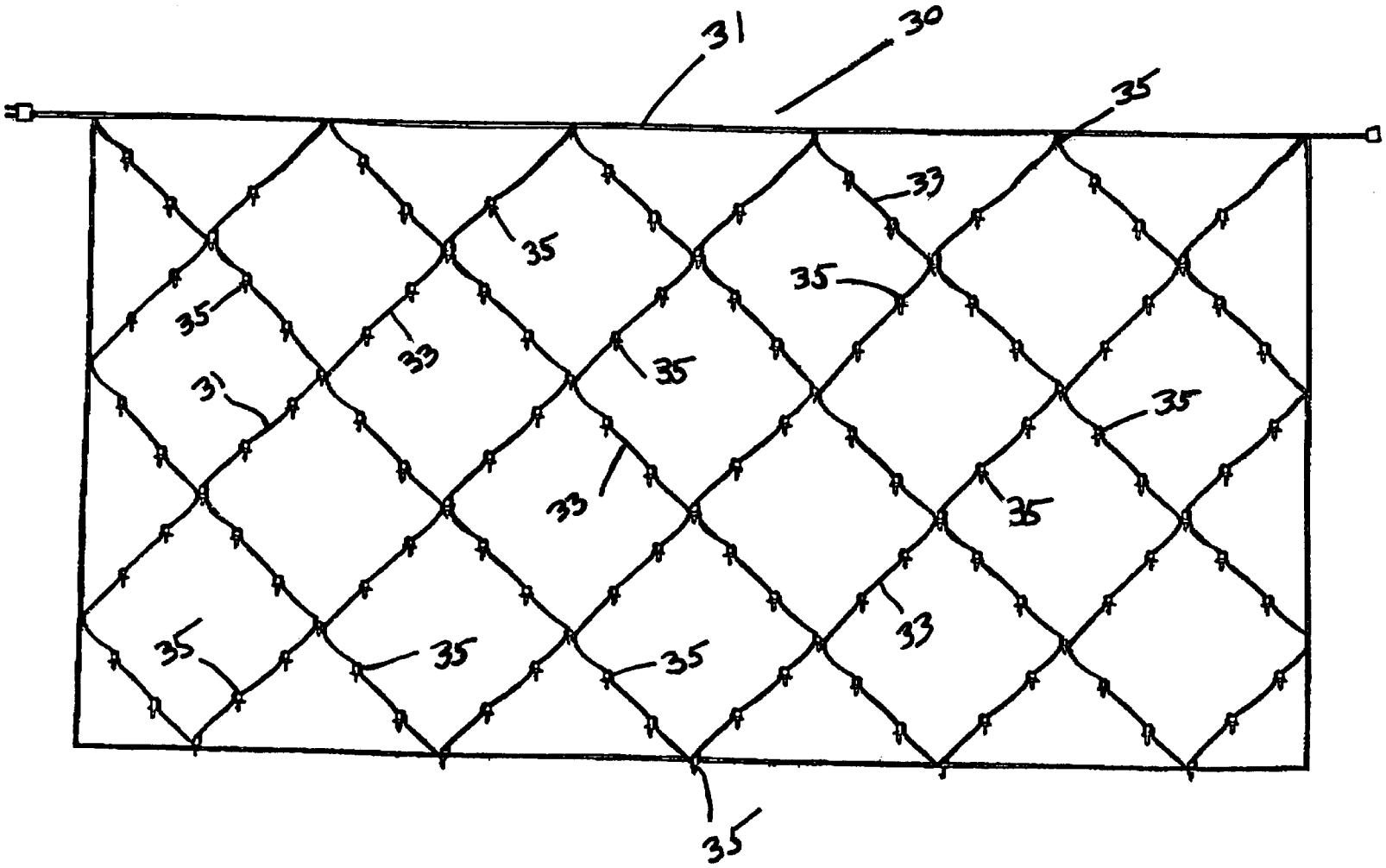
FIG. 6 is a view similar to FIG. 2 but wherein single wires rather than intertwined wires are used to energize the lamps.

The subnet of lighting network shown in FIG. 6 is similar to FIG. 1 except for using single wire for establishing electrical contact with the lamps. Thus, a single wire 27 is used to energize the lamps 29 by entering the lamps, establishing contact with the electrical filament, and out of the lamp into the next succeeding lamp in the series. The individual lamps 29 are structurally the same as the lamps 11 in FIGS. 1–4.

The embodiment shown in FIG. 7 is similar to the embodiment illustrated in FIG. 2 except for using 12 lamps per subnet of the lighting network. Thus, as in the network of FIG. 1, the network 30 in FIG. 6 comprises a top row 31 of wire 33 from which depends an array of subnets 33 with each subnet comprising 12 lights, in series, as in the subnets of FIG. 1. Each subnet is generally diamond-shaped in configuration and comprises a lamp 35 at the four corners or nodes and two lamps on each sides, for a total of twelve lights. The network structure and interconnection of lamps are otherwise the same as previously described in connection to FIGS. 1–4. A subnet 33 of the network is shown in FIG. 7.

As previously mentioned, the lighting network assembly of the present invention permits the use of less quantity of wire per each light (lamp) used in the network. This is illustrated in the following table which compares the quantity (length) of wire used for the same number of total lights as illustrated in FIGS. 8A–8D.

TABLE

Figure 8A:
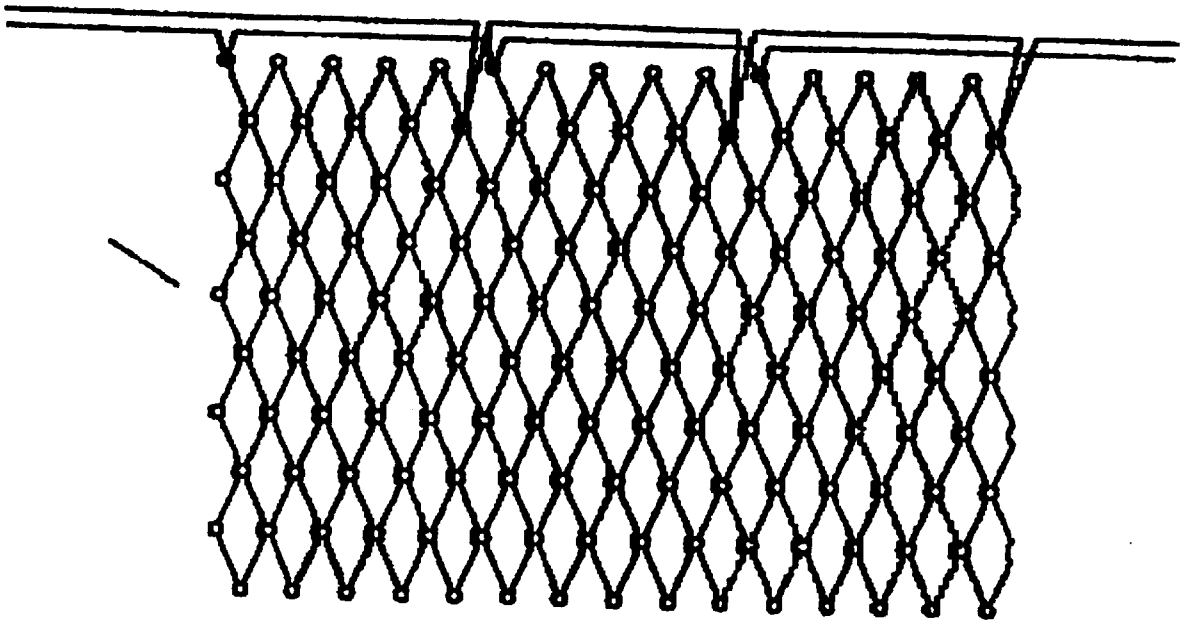
FIG. 8A PRIOR ART
FIG. 8A is a representative prior art network of lights, 4 by 6 feet in dimensions, consisting of 150 lights having 4 lights per subnet.
Figure 8B:
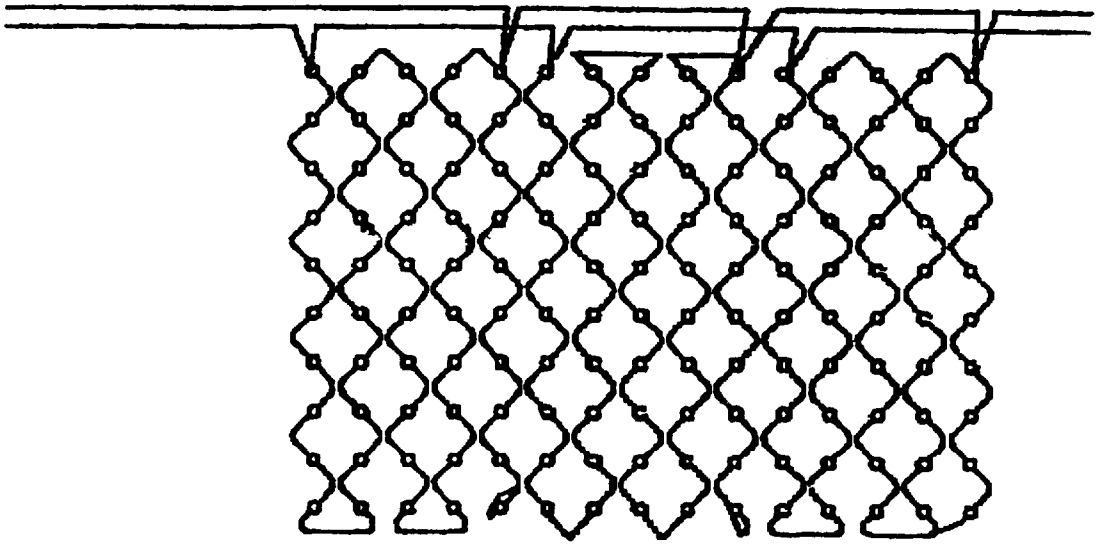
FIG. 8B PRIOR ART
FIG. 8B is another representative prior art network of lights, 4 by 6 feet in dimensions, consisting of 150 lights having 4 lights per subnet.
Figure 8C:
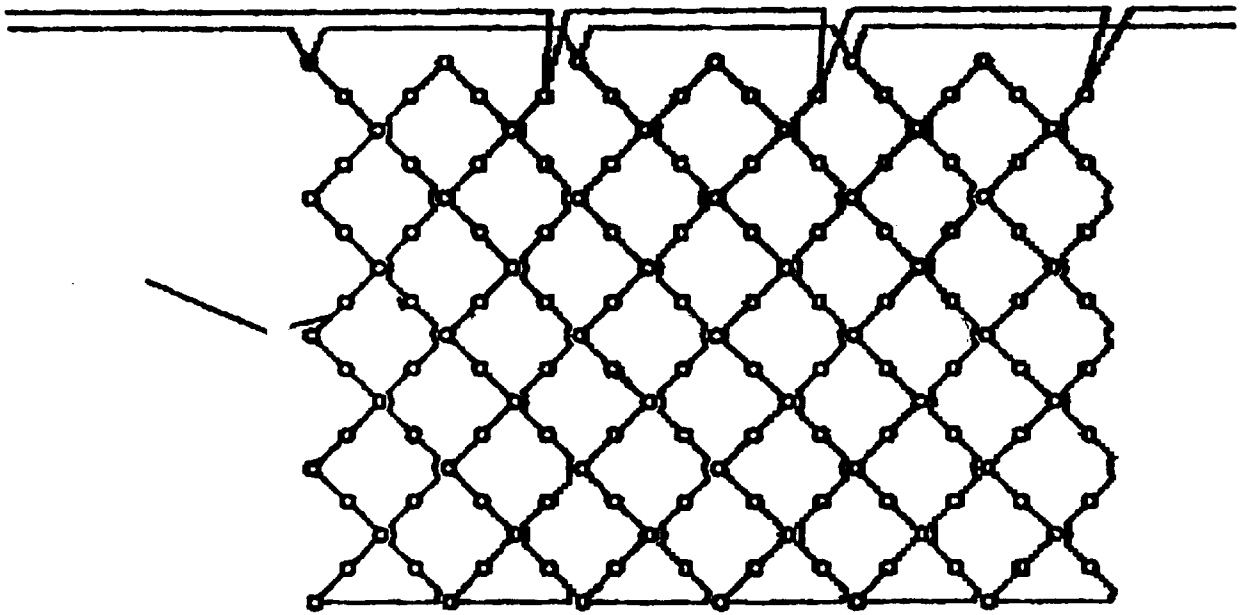
FIG. 8C represents a network of lights according to the present invention, 4 by 6 feet in dimensions, consisting of 150 lights having 8 lights per subnet.
Figure 8D:
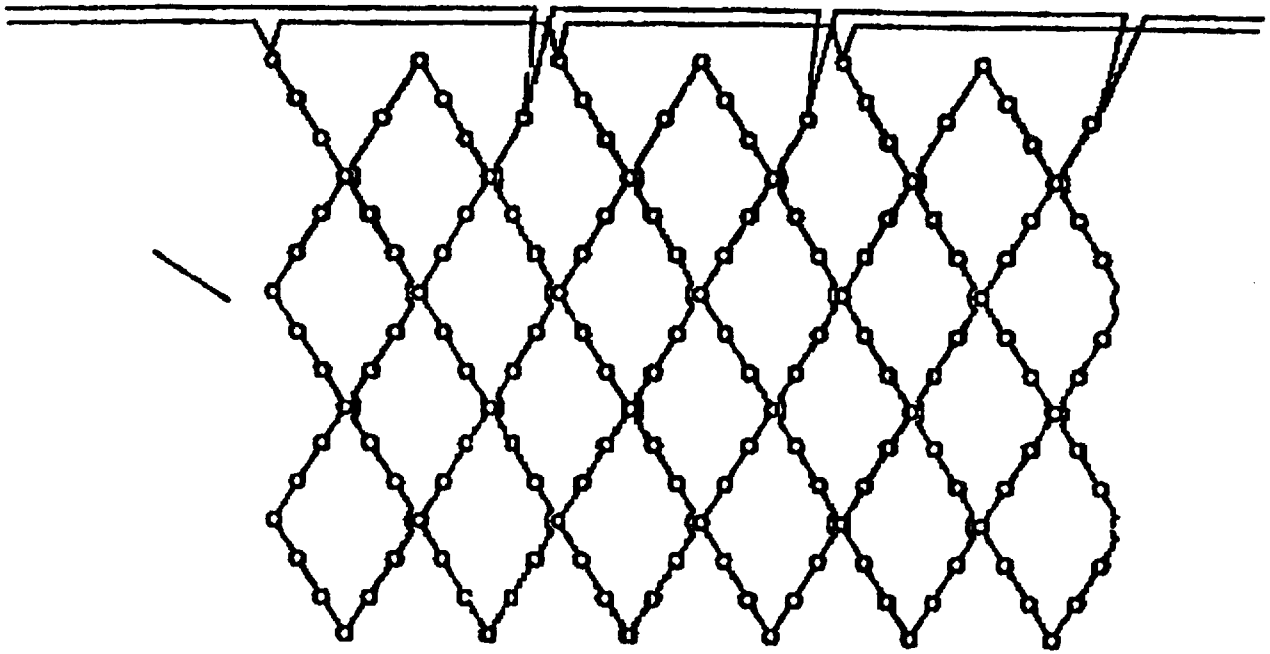
FIG. 8D represents a network of lights according to another embodiment of the present invention, 4 by 6 feet in dimension, consisting of 150 lights having 12 lights per subnet.

| Lighting network | Lights per subnet | Approximate feet of wire |
|---|---|---|
| FIG. 8A | 4 | 170.6 |
| FIG. 8B | 4 | 142 |
| FIG. 8C | 8 | 108.3 |
| FIG. 8D | 12 | 89 |

As it can be seen from the above table, substantially less quantity of wire is needed in the embodiment of the invention represented by FIGS. 8C and 8D compared to the prior art lighting network represented by FIGS. 8A and 8B.

While the present invention has been described with some degree of particularity, it is apparent to those skilled in the art that some changes or modifications can be made which are suggested from the disclosure herein. For example, more than twelve lamps may be used per subnet if desired, and the subnet configuration may assume a different shape, such as, e.g., square, rectangular, circular or oval. These lamps may be spaced apart equidistantly or at different distances from each other but in either case less wires will be required to accommodate the same number of lights as in the prior art lighting network.

What is claimed is:

1. A decorative network of lights adapted to be draped over a Christmas tree, said network comprising:

(a) a row of intertwined wires comprising an electronically conductive insulated wire and a non-conductive wire, (b) at least one light string depending from said row of intermittent wires and defining a plurality of generally diamond-shape subnets, each subnet having a lamp at each node of said subnet and at least one lamp intermediate the lamps at the nodes of each of said subnets, wherein each of said electrically conductive wire is in electrical contact with each of said lamps and each of said non-conductive wires is disposed adjacent each of said lamps without making electrical contact with said lamps.

2. A decorative network of lights as in claim 1 wherein said intertwined wires are secured adjacent each of said lamps by a retaining means.

3. A decorative network of lights as in claim 1 wherein at least two lamps are disposed intermediate the lamps at the nodes of each of said subnets.

4. A decorative network of lights as in claim 3 wherein said intertwined wires are secured adjacent each of said lamps by a retaining means.

5. A decorative network of lights adapted to be draped over a Christmas tree, said network comprising (a) a row of single electrically conductive insulated wire, (b) at least one light string depending from said row of single wire and defining a plurality of generally diamond-shaped subnets, each subnet having a lamp at each node of said subnet and at least one lamp intermediate the lamps at the nodes of each of said subnets, wherein each of said wires passes through each of said lamps to establish electrical contact, exists from said lamp and extends toward the nest lamp, in series, and establishes electrical contact therewith while forming the lighting network.

6. A decorative network of lights as in claim 5 wherein said wire is secured adjacent each of said lamps by a retaining means.

7. A decorative network of lights as in claim 5 wherein at least two lamps are disposed intermediate the lamps at the nodes of each of said subnets.

8. A decorative network of lights as in claim 7 wherein each single wires are secured adjacent each of said lamps by a retaining means.

* * * * *